US005707083A

United States Patent [19]

Wallace

[11] Patent Number: 5,707,083

[45] Date of Patent: Jan. 13, 1998

[54] SECURITY DOCUMENTS WITH MULTI-ANGLED VOIDS

[75] Inventor: Stephen J. Wallace, Lockport, N.Y.

[73] Assignee: Moore Business Forms, Inc., Grand Island, N.Y.

[21] Appl. No.: 700,772

[22] Filed: Aug. 22, 1996

[51] Int. Cl.[6] ..... B42D 15/00

[52] U.S. Cl. ..... 283/93; 283/902

[58] Field of Search ..... 283/93, 72, 114, 283/902; 380/3, 51, 54

[56] References Cited

U.S. PATENT DOCUMENTS

| | | | |
|---|---|---|---|
| 4,227,720 | 10/1980 | Mowry, Jr. et al. . | |
| 4,582,346 | 4/1986 | Caprio et al. . | |
| 5,018,767 | 5/1991 | Wicker . | |
| 5,149,140 | 9/1992 | Mowry, Jr. et al. | 283/93 |
| 5,193,853 | 3/1993 | Wicker . | |
| 5,197,765 | 3/1993 | Mowry, Jr. et al. | 283/93 |
| 5,297,815 | 3/1994 | Anderson et al. | 283/902 X |
| 5,479,507 | 12/1995 | Anderson | 283/902 X |

FOREIGN PATENT DOCUMENTS

| | | |
|---|---|---|
| 1070731 | 1/1980 | Canada . |
| 1138011 | 12/1968 | United Kingdom . |

OTHER PUBLICATIONS

Lewis, "Built-in Copyright Protection", Professional Photographer, Oct., 1995, p. 72.

Samples created by Amgraf, Inc./Golden Transport Co. sample checks, 1995.

*Primary Examiner*—Willmon Fridie, Jr.

*Attorney, Agent, or Firm*—Nixon & Vanderhye P.C.

[57] ABSTRACT

A document that is substantially copy proof even using modern digital color copiers may also be constructed so that it is scanner and image friendly. The document includes at least first through fourth areas each having colored background lines at a first angle and colored VOID lines at a second angle, the second angle being at least 20° different than the first angle, but not 70°–110° or 160°–200° different. At least one of the first and second angles for each of the areas is at least about 10° different than the first and second angles for the other areas. Substantially all of the background and VOID lines have a black content of at least 15% and a density of between about 7–22%. For scanner and image friendly documents the density must be between about 10–12%. All of the lines in the areas have an average maximum line width variation of about 0.0005 inches. The background and VOID lines typically all have a frequency of between about 97–103 lines per inch. The document includes first and second quality control sections adjacent opposite edges of the document, the first quality control section having a density that is about 2% greater than the main body of the document, and the second quality control section having a density that is about 5% greater.

25 Claims, 3 Drawing Sheets

SECURITY DOCUMENTS WITH MULTI-ANGLED VOIDS

BACKGROUND AND SUMMARY OF THE INVENTION

In the early days of the production of copy proof documents (that is documents that indicated that copies made by color copiers were in fact copies) the technology relied upon was different sized dots. For example in U.S. Pat. No. 4,227,720 large dots could be reproduced by a color copier whereas small dots could not, the larger dots forming the word "VOID". However that technology became ineffective with the introduction of sophisticated digital color copiers, which use scanners that scan the document and recompose it. In order to provide a copy proof document for effective use with digital copiers, documents produced as shown in U.S. Pat. No. 5,018,767 were utilized. This later technology relies on lines that have specific angles (including orientations with respect to the direction of scanner movement), frequencies and densities that interfere with the copying process and typically cause color distortions in the copied document. Utilizing the later technology four or more "VOID" images formed by lines, having different orientations with respect to scanner movement, are provided at different areas of the document. Since the VOID images have different angles with respect to the direction of scanner head movement, even if the document is reoriented on a color copier glass platen the copy proof features will be effective. Also, by placing bordered warning bands which identify proper color it is possible to minimize the ability of a counterfeiter to defeat the copy proof features of the document by using the color controls of the copier to lighten the screened image to the extent where there is not enough contrast for the distortion effect to take place.

Despite the advantages of the latest technology described above there are certain drawbacks associated therewith. In particular the color copier may be de-focused so that the lines are no longer seen with their correct spacing. This may be done electronically by entering photo mode or mechanically by changing the focal length of the system (such as by raising the document off of the glass platen using some type of clear film). Also postal scanners and bank imaging equipment use the same basic scanner technology and the production of documents with strong VOID characteristics requires the exact opposite features as making documents that are scanner and image friendly. Also line uniformity is very important in producing documents described above, and very often necessary quality control or other features do not exist to ensure production of documents with lines having the necessary tolerances.

Copier deterrent features are improved by increasing the density and black content (that is the percentage of black ink contained in any given color; PMS charts typically list percentages of all inks used in blending of a given color), but image friendliness is improved by lowering densities and reducing black content. Therefore it is necessary to be able to produce imaged (printed) lines on the copy proof document that are smooth with little variation, having uniform density and thickness over their entire length and width. Broken lines or gaps, uneven or excessive variations in line width, line density variations from light to dark across the document, and specks or blotches of ink above or below the lines, all must be avoided in order to ensure an effective document.

According to the present invention, copy resistant documents may be produced that are much less susceptible to defocusing, are more easily evaluated for compliance with appropriate line uniformity, and are both scanner and image friendly and substantially copy proof.

According to the present invention it has been found that a black content of at least about 15%, preferably between about 15–20%, is necessary for colored lines if they have a density of 10% or higher. If the density is lower than 10%, then a black content of more than 20% is typically necessary. The term "color" or "colored" used in the present specification and claims with respect to a line means a line having a predominate color other than black, white, or yellow (e.g. 242 Purple, 296 Blue, etc.). Colors that contain significant amounts of white and/or yellow decrease the distortion effect and make it necessary to raise the black content.

According to the invention it has also been recognized that there is a narrow effective density range for making documents that are both image and scanner friendly and substantially copy proof. Optimum density and line width is affected by color, but generally ranges from about 10–12% for density, and desired line width is about 0.0025 inches±0.00025 inches.

It has been found according to the present invention that it is possible to effectively determine document quality by providing three sections of the document. The central section has a standard appropriate density (i.e. between about 7–22% if only copy proof aspects are important, but between about 10–12% if image and scanner friendliness is also necessary). On opposite edges of the document, typically in bands that are about one inch or less in width, first and second quality control sections are provided. The first quality control section has a density of about 2% greater than that of the central section, while the second quality control section has a density about 5% greater than the central section. (If extra diligence is taken when reading the 5% QC area the 2% bar may be dropped.)

The documents provided according to the present invention are—for high end color copiers and before mentioned line colors—effective even if attempts are made to use color controls to lighten the screened image (the background will change to white alerting that it is counterfeit), or if the document is rotated so as to place it at an angle where no print lines are parallel or perpendicular to the direction of scanner head movement.

According to one aspect of the present invention a document that is both scanner and image friendly, and substantially copy resistant, is provided which comprises: First through fourth areas each having colored background lines at a first angle and colored VOID lines at a second angle, the second angle being at least about 20 degrees different than the first angle, but not 70–110 degrees or 160–200 degrees different. [The term "VOID lines" as used in the present specification and claims means lines that are in the configuration of the word "VOID" or some other indication of the fact that the document has been copied, and is not an original document, such as "COPY", "DO NOT CASH", or a symbol.] At least one of the first and second angles for each of the first through fourth areas is at least about 10 degrees different than the first and second angles for each of the other first through fourth areas. And, substantially all of the background and VOID lines have a black content of at least about 15%, and a density of between about 10–12%, so that the document is both scanner and image friendly and substantially copy proof.

While the frequency may vary depending upon the particular color copier that is most likely to be encountered, or other parameters, typically the frequency of all of the lines is between about 97–103 lines per inch. Preferably the lines have a line width of between about 0.0025–0.003 inches and an average maximum line width variation of about 0.0005 inches. The colored background and VOID lines in each of the first through fourth areas may be of substantially the same color, and preferably as a further copy proof feature a color image is placed on the document which has little or no black content. The little or no black content color image guards against the possibility of copiers properly copying the document in black and white mode.

The VOID lines typically include lines that are at angles between about 0°–15° (preferably about 5°) from the direction of travel of a copier scan head (if laid against a copy guide, which is conventional on color copier glass platens), and also from 90° to the direction of travel of the copier scan head. Typically there are also at least fifth through eighth areas which have the same characteristics as the first through fourth areas, with at least one of the first and second angles for each of the first through eighth areas being at least about 10° different than the first and second angles for each of the other of the first through eighth areas. Preferably areas are provided with colored background lines and colored VOID lines so that lines are provided at substantially all angles between about 95°–175° at about 10° increments, with respect to the direction of travel of a copier scan head for a document laid against the copy guide. For example at least four large VOID areas which copy at the normal copy angles, four somewhat smaller areas which copy at 90° and 45°, and as many smaller areas as the document construction will allow at other angles, may be provided.

The document has first through fourth edges, typically the first and third edges being parallel to each other and opposite each other, and the second and fourth edges being parallel and opposite each other. First and second quality control sections are provided each adjacent one of the first and third edges, the first quality control section having a density that is about 2% greater, and the second quality control section having a density that is about 5% greater, than the density of the first through fourth areas. Each of the quality control sections has a width of about ⅛ inch or less. In the preferred embodiment the first through fourth areas have a substantially uniform density of about 10%, so that the first quality control section has a density of about 12%, and the second a density of about 15%.

According to another aspect of the present invention a copy proof document may be provided comprising: First through fourth areas each having colored background lines at a first angle and colored VOID lines at a second angle, the second angle being at least about 20 degrees different than the first angle, but not 70–110 degrees or 160–200 degrees different. At last one of the first and second angles for each of the first through fourth areas is at least about 10 degrees different than the first and second angles for each of the other first through fourth areas. And, substantially all of the background and VOID lines have a black content of at least about 15%, a density of between about 7–22%, and all of the lines in the first through fourth areas have an average maximum line width variation of about 0.0005 inches so that the document is substantially copy resistant. The details of the document may be as described above.

According to another aspect of the present invention a substantially copy resistant document having first through fourth edges is provided comprising: First through fourth areas each having colored background lines at a first angle and colored VOID lines at a second angle, the second angle being at least about 20 degrees different than the first angle, but not 70–110 degrees or 160–200 degrees different. At least one of the first and second angles for each of the first through fourth areas is at least about 10 degrees different than the first and second angles for each of the other first through fourth areas. Substantially all of the background and VOID lines have a black content of at least about 15%, and a density of between about 7–22%, so that the document is substantially copy proof. And, first and second quality control sections each adjacent one of the first through fourth edges, the first quality control section having a density that is about 2% greater, and the second quality control section having a density that is about 5% greater, than the density of the first through fourth areas. If the density of the areas is less than about 10% the color of the lines should have a black content of at least about 20%. The details of the copy proof document may be as set forth above.

According to another aspect of the present a method of making a copy proof document as described above, having a central section and first and second quality control sections, is provided using a press which images the document on a roll of paper. The method comprises the steps of: (a) At least at approximately the beginning and end of each roll performing a quality control check of the document by taking measurements on the imaged document itself in each of the central, first, and second sections of the document to determine if the average line width of all lines in the central section are about 0.0025 inches±0.0005 inches, and in each of the first and second sections is about 0.0030 inches±0.0005 inches; and (b) if necessary make press adjustments to ensure that the line widths are within the ranges set forth in step (a) above as determined by measurements taken after press adjustments are effected. There may also be the further steps of: (c) Evaluating the lines in the imaged document to insure that there are no broken lines or gaps, or uneven or excessive variation in width lines, or line density varying from light to dark across the document, or specs or blotches of ink above or below the lines; and (d) if necessary making press adjustments to make the lines smooth with little variation. Steps (a) and (c) may be practiced substantially simultaneously, and steps (b) and (d) may be practiced substantially simultaneously.

It is the primary object of the present invention to provide for the effective production of copy proof documents, and particularly copy proof documents that are scanner and image friendly. This and other objects of the invention will become clear from an inspection of the detailed description of the invention and from the appended claims.

DETAILED DESCRIPTION OF THE DRAWINGS

The invention relates to documents that have security features so that they are not easily reproduced by counterfeiters using color copiers, such as a wide variety of models manufactured by Canon and Xerox. Such documents are typically referred to as "copy proof" or "copy resistant" documents, and may be used for a wide variety of purposes, such as bank checks, traveler's checks, title documents, certificates of authenticity of all types, money orders, etc.

Figure 1:
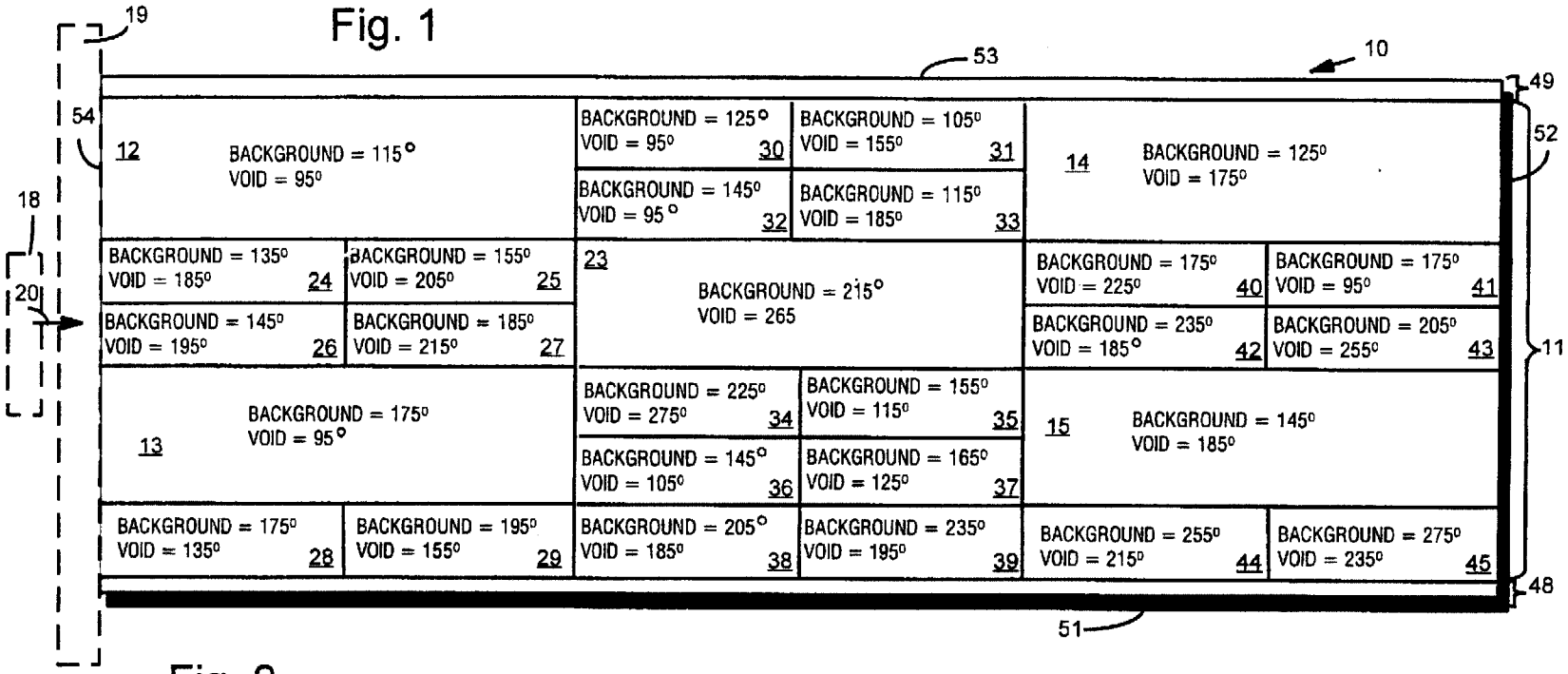
FIG. 1 is a schematic plan view of an exemplary document according to the present invention showing the plurality of different sections and areas thereof which have different features, and shown in association with a paper guide and scanner head of a color copier.
Figure 2:
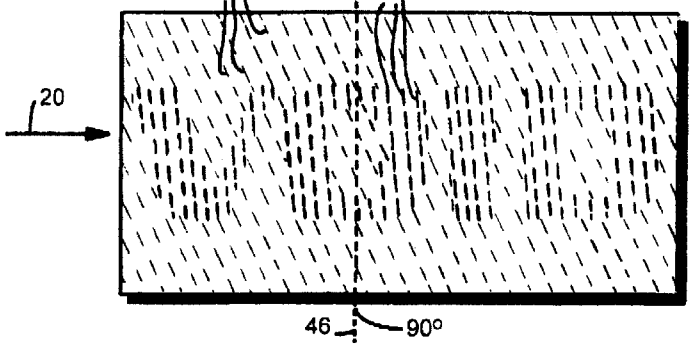
FIG. 2 is a detail view of one of the areas of the document of FIG. 1.

FIG. 1 is a schematic view of an exemplary copy proof document, shown generally by reference numeral 10, according to the present invention. The document 10 includes a main, central section 11 which has various lines printed or otherwise imaged thereon at desirable angles, and having desirable density and frequency characteristics, so as to make the document 10 copy proof. The document 10 has at least first through fourth areas shown generally by reference numerals 12 through 15 in FIG. 1. Each of the areas has colored background lines at a first angle and colored VOID lines at a second angle. FIG. 2 is an enlarged detail view showing the configuration of the lines for the block/area 12.

As seen in FIG. 2 there are a plurality of colored background lines 17 at a first angle, which in this particular embodiment is angled about 115°. All angles given herein are with respect to the direction of movement of the scanner head 18 (see FIG. 1) during operation of a conventional digital color copier, with the document 10 against the supporting edge of a conventional copy guide 19 associated with a glass platen of the copier. The scanner head 18 moves in the direction indicated schematically by arrow 20 in FIG. 1. The colored VOID lines 21 are at a second angle, in the case of the area 12 of FIG. 2 the second angle being 95°.

Note that the lines 17, 21 are shown as discontinuous lines. The extent of discontinuity will depend upon the density of the line and is typically effected automatically by a composition computer and related software, such as the MECCA System which utilizes lasers. The second angle 21 is at least about 20° different than the first angle 17, but not at 70°–110° or 160°–200° different since that could result in an unworkable product.

At least one of the first and second angles for the lines 17, 21 for each of the first through fourth areas is different by at least about 10° from the first and second angles of the lines for each of the other areas 12 through 15, as seen in FIG. 1, which lists the background and VOID angles (for the lines 17, 21 respectively) for each of the areas on the face of the document 10.

As seen in FIG. 1, preferably there are many more than four areas, all having at least one of the first and second angles of each of the areas at least about 10° different than the first and second angles for each of the other areas, or for at least some of the other areas. In the particular embodiment illustrated in FIG. 1 in addition to the major areas 12 through 15 there is also a major area 23, and twenty-two different minor areas (each with its own "VOID") indicated by reference numerals 24 through 45. Typically there are at least first through eighth areas, at least one of first and second angles for each of the first through eighth areas being at least about 10° different than the first and second angles for each of the other areas. Each of the areas 23 through 45 in FIG. 1 has the angles of the background and VOID lines thereof indicated in the figure.

Substantially all of the background and VOID lines 17, 21 will have a black content of at least about 15%. Normally where the density of the lines 17, 21 is 10% or above the black content will be in the range of about 15–20%. However where the density of the lines 17, 21 is less than 10%, the black content must be higher, at least 20%. The black content that is optimum depends upon the particular color of the lines 17, 21. Colors that contain a significant amount of white and/or yellow (typically determined from PMS charts) decrease the distortion effect that results from copying, and make it necessary to raise the black content for that particular color.

The lines 17, 21 preferably have a substantially uniform density within an area (such as the area 12), although the density may vary from area to area. In many circumstances, however, the density be substantially uniform throughout the central section 11, and will be between about 7–22%. While the limits of density are somewhat dependent upon ink color, and the copiers one is trying to defeat, or the scanning equipment that one is trying to be "friendly" with, densities outside the range of 7% to 22% are typically ineffective. If it is necessary that the document be both scanner and image friendly, and substantially copy proof, then the range of acceptable densities is much less, that is between about 10–12%. If the density is higher than this the lines will tend not to be image friendly, and if the density is lower than this the lines tend to drop out totally when copied by color copiers.

As seen in FIG. 1, it is highly desirable to provide VOID lines 21 that include lines that are angled between about 0°–15° from the direction 20 of travel of the copier scan head 18 for a document 10 laid against the copy guide 19, and also at angles between about 0°–15° from 90° to the direction of travel of the copier scan head (the line 46 in FIG. 2). For cosmetic reasons, 0° and 90° lines should be offset about 5°, an offset of about 5° being optimum for both 0° (in the direction of arrow 20) and 90° (line 46). This may not be necessary for all copiers, but is typically utilized because the type of copiers that the document 10 may be used with cannot normally be known in advance. Conventional Xerox copiers generally show a greater distortion when the lines are perpendicular to the scan direction 20, while Canon copiers typically show little if any differentiation between parallel and perpendicular lines (with the exception of the Canon 700 where perpendicular lines distort at slightly lower densities and line width than parallel lines). As seen in FIG. 1, angles are used for the lines 17, 21 that cover substantially all angles between about 95°–175° at about 10° increments with respect to the direction of travel 20 of copier scanner head 18 for a document 10 laid against the copy guide 19.

According to the invention line width uniformity is also important to ensure optimum results. For this purpose according to the present invention first and second quality control sections 48, 49 are provided. The document 10 has first through fourth edges 51–54 and the first and second quality control sections 48, 49 are each adjacent one of the edges. Preferably the section 48 is adjacent the edge 51, and the section 49 adjacent the edge 53 which is parallel to the edge 51 and opposite it. The first quality control section 48 has a density that is about 2% greater than the density of the central section 11 (or at least the void areas, such as 12–15, therein), and the second quality control section 49 has a density that is about 5% greater than the density of the first through fourth areas 12 through 15. Each of the quality control sections 48, 49 preferably comprises a band—as illustrated in FIGS. 1 and 3—with a width of about ⅛ inch or less.

Figure 3:
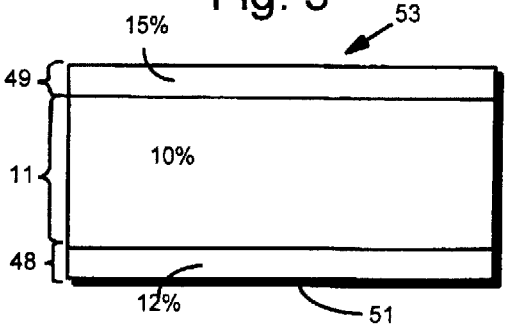
FIG. 3 is a plan schematic view of the major sections of an exemplary document according to the present invention.

As schematically illustrated in FIG. 3, where the central section 11 has a density of about 10%, the section 48 has a density of about 12% and the section 49 a density of about 15%. It should be understood that under some circumstances not all of the section 11 will be included in the void producing areas 12 through 15 and 23 through 45, but there will be areas which do not have the void producing elements. These areas may have different densities and will not affect the relative densities to be provided between the portions of the section 11 having the areas 12 through 15, etc. and the quality control sections 48, 49.

Figure 4:
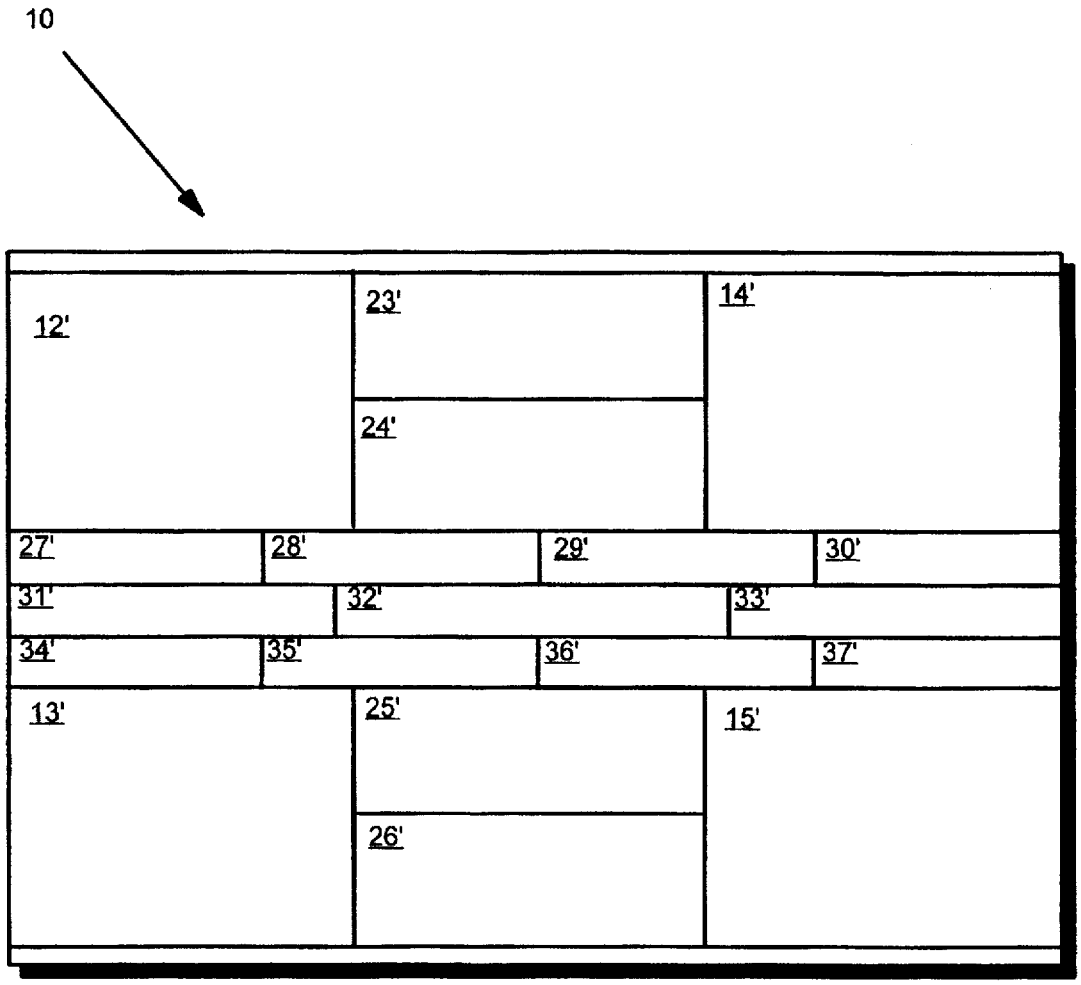
FIG. 4 is a view like that of FIG. 1 only showing a different configuration of the copy void areas.

FIG. 4 is an illustration of a document 10' like the document 10 only having a different configuration of the void producing areas thereof. In FIG. 4 all of the components corresponding to similar components in FIG. 1 are shown by the same reference numeral only followed by a "'". In this particular embodiment lines start at an angle of 95° and cover a 180° arc in about 10° steps, resulting in a total of nineteen angles. The areas 12' through 15' are large VOIDS which show at the normal copy angle, the blocks 23'–26' are somewhat smaller and show VOIDS at 90° and 45° angles, and the blocks 27'–37' are provided at other angles, as many of these other blocks 27'–37' being provided as allowed given the size of the document 10'.

Of course when the documents 10, 10' are produced they can have full tone or halftone printed indicia thereon, such as check numbers, bank names, MICE numbers, or the like. Those overprinted indicia typically occupying less than 15% of any given block do not affect the security features of the documents 10, 10'.

Where it is desirable to avoid the possibility of a color copier automatically copying in black and white mode, which might defeat the copy proof features of the documents according to the invention (in view of the black content and density thereof), it may be desirable to place an image of a color that has little or no black content somewhere on the document. This is illustrated schematically for the image 58 in FIG. 4, which may be two different shades of yellow having essentially no black content, and not reproducible in black and white mode. Indicia could be provided in one of the sections 48, 49, or elsewhere in the document, indicating that a yellow sunflower 58, or like image, must appear otherwise the document is invalid.

The documents 10, 10' are typically designed by photo composition systems, such as the MECCA System. The laser output of the laser associated with the MECCA System must be set at 2540 DPI or more, and the lasers must be certified by burning a diagnostic negative, copying the negative to plate, and then running the plate on an improved press. It may be necessary to make compensating adjustments to the software to allow for laser variation. Lasers must be requalified when mechanical and electrical adjustments are made that may affect laser output, and only certified lasers may be used.

When the document 10 is imaged on a press it is necessary to perform (automatically if suitable equipment is available, but normally manually) a quality control check of the document 10 by taking measurements on the imaged document 10 itself (not the negative) in each of the sections 11, 48 and 49 to determine average line width in the sections. Typically, utilizing a 100 power scope where each division of space indicated on the scope is a spacing of 0.0005 inches, and utilizing a flat hard and well lit surface, the section 11 is viewed to ensure that the average line width of the lines therein (both the lines 17 and 21) is about 0.0025 inches±0.0005 inches. The quality control sections 48, 49 are inspected to see that the lines are about 0.0030 inches±0.0005 inches in the width. If necessary one makes press adjustments to ensure that the lines are within the guidelines as set forth above, as determined by measurements taken after press adjustments are effected. Press adjustments may include replacement or repair of the plate or blanket, evaluation for replacement of the ink composition and temperature, replacement of the worn bearings or repairing gears to eliminate excessive slack, cleaning of the surrounding components or fluids utilized, and the like. Typically excessive variation (greater than 0.0005 inches) indicates a press or ink problem.

Figure 5:
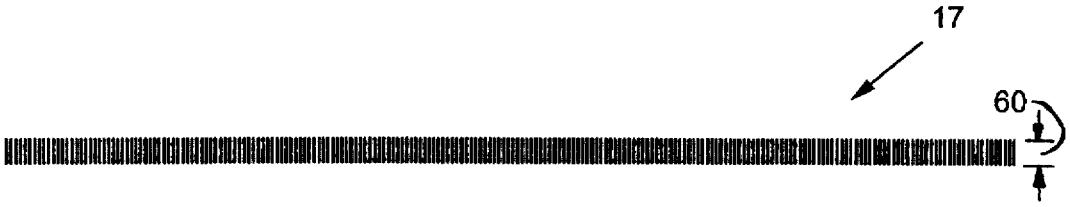
FIG. 5 is an enlarged schematic view of an exemplary line utilized in the document of the invention, which line has uniform density and thickness over its entire width and length.
Figure 6:
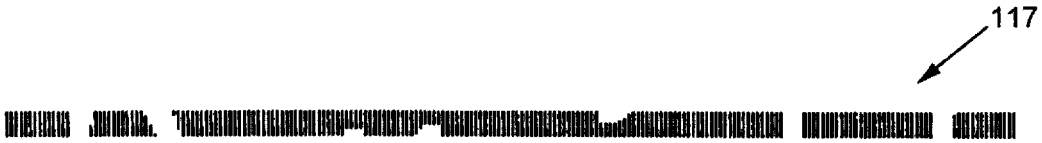
FIGS. 6 through 9 are views like that of FIG. 5 but for lines having unacceptable characteristics for the production of documents according to the present invention.

FIGS. 5 through 9 schematically illustrate various line configurations that are significant. FIG. 5 illustrates an ideal line 17, 21 according to the invention, that is one having uniform density and thickness over its entire width 60 (e.g. typically 0.0025 inches±0.0005 inches) and length. The line 117 illustrated in FIG. 6 is unacceptable, having breaks and gaps. Possible causes of the breaks and gaps may be defective blankets or plates, uneven impressions, bad ink form, or water from the rollers. The range of thickness for the lines 17, 21 to be uniform is shown in the following Table I:

TABLE I

| | Line Width Specification (in inches) | |
|---|---|---|
| | Form Body Line Width | Minimum Bottom QC Bar Line Width (form body density +5% area) |
| TOO NARROW | .0015–.002 | .002–.0025 |
| | .002–.002 | .0025–.0025 |
| ACCEPTABLE | .002–.0025 | .0025–.003 |
| | .0025–.0025 | .003–.003 |
| | .0025–.003 | .003–.0035 |
| | .003–.003 | .0035–.0035 |
| TOO WIDE | .003–.0035 | .0035–.004 |
| | .0035–.0035 | .004–.004 |

Figure 7:
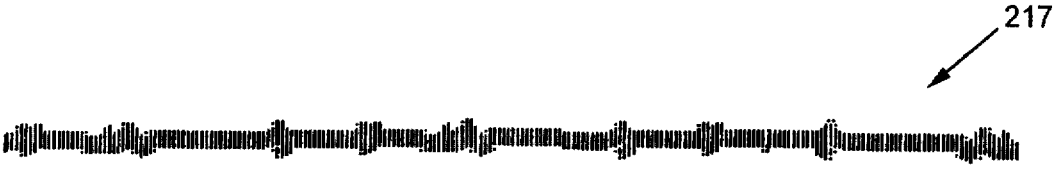
Figure 8:
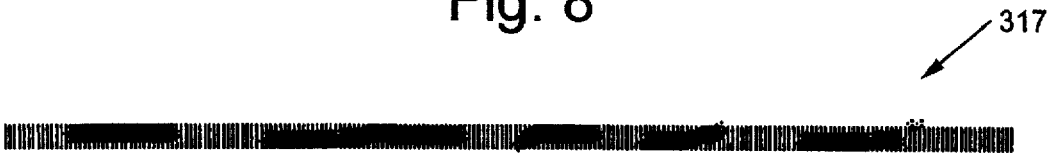
Figure 9:
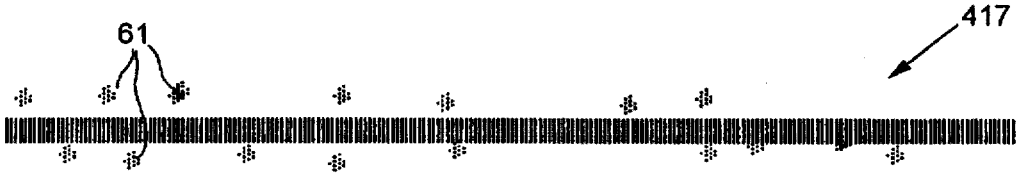

FIG. 7 indicates another unacceptable line 217. The line has uneven or excessive variations in line width. Possible causes are a worn plate, roller bounce, excessive gear slack, worn bearings, or a worn blanket. FIG. 8 shows another unacceptable line 317 having line density which varies from light to dark across the document. This may be caused by defective plates or blankets, too much water, improper ink/water balance, bounce in ink form, or water form rollers. FIG. 9 illustrates another line 417 that is unacceptable, the line 417 having specks or blotches 61 of ink above or below the line 417. The blotches 61 may be caused by a defective plate, dirty water, emulsification of the ink, or running too heavy an ink film.

After press adjustments are effected to address any of the problems illustrated by the line of FIGS. 6 through 9, the appropriate quality control check as described above will take place.

It will thus be seen that according to the present invention a copy proof document is provided which overcomes a number of the drawbacks in the prior art, and which may also provide a document that is not only copy proof but also scanner and image friendly.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and methods.

What is claimed is:

1. A document that is both scanner and image friendly, and copy resistant, comprising:

first through fourth areas each having colored background lines at a first angle and colored VOID lines at a second angle, said second angle being at least about 20 degrees different than said first angle, but not 70–110 degrees or 160–200 degrees different;

at least one of said first and second angles for each of said first through fourth areas being at least about 10 degrees different than said first and second angles for each of said other first through fourth areas; and substantially all of said background and VOID lines having a black content of at least about 15%, and a density of between about 10–12%, so that said document is both scanner and image friendly and substantially copy proof.

2. A document as recited in claim 1 wherein substantially all of said lines have a frequency of between about 97–103 lines per inch.

3. A document as recited in claim 1 wherein said VOID lines include lines that are at angles between about 0–15 degrees from the direction of travel of a copier scan head for a document laid against a copy guide, and also from 90 degrees to the direction of travel of a copier scan head.

4. A document as recited in claim 3 wherein said VOID lines include lines that are at angles between about 5 degrees from the direction of travel, and perpendicular to the direction of travel, of a copier scan head.

5. A document as recited in claim 4 further comprising at least fifth through eighth areas each having colored background lines at a first angle and colored VOID lines at a second angle, said second angle being at least about 20 degrees different than said first angle, but not 70–110 degrees or 160–200 degrees different;

at least one of said first and second angles for each of said first through eighth areas being at least about 10 degrees different than said first and second angles for each of said other of said first through eighth areas; and substantially all of said background and VOID lines having a black content of at least about 15%, a density of between about 10–12%, and an average maximum line width variation of about 0.00025 inches, so that said document is both scanner and image friendly, and copy proof.

6. A document as recited in claim 5 wherein areas are provided with colored background lines and colored VOID lines so that lines are provided at substantially all angles between about 95–175 degrees at about 10 degree increments with respect to the direction of travel of a copier scan head for a document laid against a copy guide.

7. A document as recited in claim 1 wherein said document has first through fourth edges, and first and second quality control sections each adjacent one of said first through fourth edges, said first quality control section having a density that is about 2% greater, and said second quality control section having a density that is about 5% greater, than the density of said first through fourth areas, each of said quality control sections having a width of about ⅛ inch or less.

8. A document as recited in claim 7 wherein said first through fourth areas have a substantially uniform density of about 10%, said first quality control section being at said first edge of said document and having a density of about 12%, and said second quality control section being at said third edge of said document, opposite said first edge, and having a density of about 15%.

9. A document as recited in claim 1 wherein said lines have a line width of between about 0.0025–0.003 inches and an average maximum line width variation of about 0.0005 inches.

10. A document as recited in claim 1 further comprising a color image on said document having little or no black content.

11. A document as recited in claim 1 wherein said colored background and VOID lines in each of said first through fourth areas are of substantially the same color.

12. A document as recited in claim 1 wherein all of said lines in said first through fourth areas have an average maximum line width variation of about 0.00025 inches.

13. A copy proof document comprising:

first through fourth areas each having colored background lines at a first angle and colored VOID lines at a second angle, said second angle being at least about 20 degrees different than said first angle, but not 70–110 degrees or 160–200 degrees different;

at last one of said first and second angles for each of said first through fourth areas being at least about 10 degrees different than said first and second angles for each of said other first through fourth areas; and substantially all of said background and VOID lines having a black content of at least about 15%, a density of between about 7–22%, and all of said lines in said first through fourth areas have an average maximum line width variation of about 0.00025 inches so that said document is substantially copy proof.

14. A document as recited in claim 13 wherein substantially all of said lines have a frequency of between about 97–103 lines per inch.

15. A document as recited in claim 13 wherein said VOID lines include lines that are at angles between about 0–15 degrees from the direction of travel of a copier scan head if laid against a copy guide, and also from 90 degrees to the direction of travel of a copier scan head.

16. A document as recited in claim 13 wherein said document has first through fourth edges, and first and second quality control sections each adjacent one of said first through fourth edges, said first quality control section having a density that is about 2% greater, and said second quality control section having a density that is about 5% greater, than the density of said first through fourth areas, each of said quality control sections having a width of about ⅛ inch or less.

17. A document as recited in claim 16 wherein said first through fourth areas have a substantially uniform density of about 10%, said first quality control section being at said first edge of said document and having a density of about 12%, and said second quality control section being at said third edge of said document, opposite said first edge, and having a density of about 15%.

18. A document as recited in claim 13 further comprising a color image on said document having little or no black content; and wherein if the density of said areas is less than about 10% the color of said lines having a black content of at least 20%.

19. A substantially copy proof document having first through fourth edges, and comprising:

first through fourth areas each having colored background lines at a first angle and colored VOID lines at a second angle, said second angle being at least about 20 degrees different than said first angle, but not 70–110 degrees or 160–200 degrees different;

at least one of said first and second angles for each of said first through fourth areas being at least about 10 degrees different than said first and second angles for each of said other first through fourth areas;

substantially all of said background and VOID lines having a black content of at least about 15%, and a density of between about 7–22%, so that said document is substantially copy proof; and first and second quality control sections each adjacent one of said first through fourth edges, said first quality control section having a density that is about 2% greater, and said second quality control section having a density that is about 5% greater, than the density of said first through fourth areas.

20. A document as recited in claim 19 further comprising a color image on said document having little or no black content; and wherein if the density of said areas is less than about 10% the color of said lines having a black content of at least 20%.

21. A document as recited in claim 19 wherein said first quality control section is at said first edge of said document and said second quality control section is at said third edge of said document, opposite said first edge, each of said quality control sections having a width of about ⅛ inch or less.

22. A document as recited in claim 19 wherein substantially all of said lines have a frequency of between about 97–103 lines per inch.

23. A method of making a copy proof document having a first through fourth edges, the first and third edges opposite each other, a central section having: first through fourth areas having each having colored background lines at a first angle and colored VOID lines at a second angle, the second angle being at least about 20 degrees different than the first angle, but not 70–110 degrees or 160–200 degrees different; the first and second angles for each of the first through fourth areas being at least 10 degrees different than the first and second angles for each of the other first through fourth areas; and substantially all of the background and VOID lines having a black content of at least about 15%, and a density of between about 7–20%, so that the document is substantially copy proof; and first and second quality control sections along the first and third edges, respectively, the quality control sections each having a width of about ⅛ inch or less, and the first section having a density about 2% greater than the central section, and the second section having a density about 5% greater than the central section; said method practiced using a press which images the document on a roll of paper, and said method comprising the steps of:

(a) at least at approximately the beginning and end of each roll performing a quality control check of the document by taking measurements on the imaged document itself in each of the central, first, and second sections of the document to determine if the average line width of all lines in the central section are about 0.0025 inches±0.0005 inches, and in each of the first and second sections is about 0.0030 inches±0.0005 inches; and (b) if necessary make press adjustments to ensure that the line widths are within the ranges set forth in step (a) above as determined by measurements taken after press adjustments are effected.

24. A method as recited in claim 23 comprising the further steps of: (c) evaluating the lines in the imaged document to insure that there are no broken lines or gaps, or uneven or excessive variation in width lines, or line density varying from light to dark across the document, or specs or blotches of ink above or below the lines; and (d) if necessary making press adjustments to make the lines smooth with little variation.

25. A method as recited in claim 24 wherein steps (a) and (c) are practiced substantially simultaneously, and steps (b) and (d) are practiced substantially simultaneously.

* * * * *